US008160288B2

(12) United States Patent
Axelsson

(10) Patent No.: US 8,160,288 B2
(45) Date of Patent: Apr. 17, 2012

(54) IN-EAR EARPHONE WITH CUSHIONING MEMBER

(75) Inventor: Per Emil Axelsson, Akarp (SE)

(73) Assignee: Sony Ericsson Mobile Communications AB, Lund (SE)

( * ) Notice: Subject to any disclaimer, the term of this patent is extended or adjusted under 35 U.S.C. 154(b) by 1088 days.

(21) Appl. No.: 12/036,473

(22) Filed: Feb. 25, 2008

(65) Prior Publication Data

US 2009/0214071 A1 Aug. 27, 2009

(51) Int. Cl.
*H04R 25/00* (2006.01)

(52) U.S. Cl. ..... 381/380; 381/328; 381/382; 128/864; 181/135

(58) Field of Classification Search ..... 381/374, 381/382–383, 380, 328, 325, 330, 324, 338; 128/864; 181/129, 130, 135
See application file for complete search history.

(56) References Cited

U.S. PATENT DOCUMENTS

2006/0147079 A1 7/2006 Jaakkola

FOREIGN PATENT DOCUMENTS

| | | | |
|---|---|---|---|
| DE | 43 39 899 | A1 | 6/1995 |
| EP | 1 594 340 | A1 | 11/2005 |
| JP | 2000-92581 | A | 3/2000 |

OTHER PUBLICATIONS

International Search Report and Written Opinion corresponding to International Application No. PCT/EP2008/058757 (12 pages); Mailing Date Oct. 21, 2008.

*Primary Examiner* — Thao Le
*Assistant Examiner* — Allen Parker
(74) *Attorney, Agent, or Firm* — Myers, Bigel

(57) ABSTRACT

An in-ear canal earphone includes a torus-shaped cushioning member defining an aperture therethrough. An audio housing is connected to the cushioning member such that the cushioning member is movable between a first position, in which the housing extends generally away from the cushioning member, and a second position, in which a portion of the housing extends through the aperture for insertion into an ear canal.

9 Claims, 5 Drawing Sheets

IN-EAR EARPHONE WITH CUSHIONING MEMBER

FIELD OF THE INVENTION

The present invention relates to earphones, and in particular, to in-ear earphones.

BACKGROUND

In-ear earphones are inserted partially into the ear canal of the user. Wireless or wired in-ear earphones can be used with devices such as cell phones, portable music devices (e.g., iPods® devices) and other electronic devices.

In-ear earphones typically include a sound tube that is configured to be inserted into the ear canal of the user. The sound tube is connected to a speaker housing, which is typically held in position outside the ear canal of the user. The sound tube can include a sheath that is sized and configured to frictionally engage the canal of the user's ear to retain the sound tube in the ear canal.

However, in-ear canal earphones can be difficult to insert correctly. In addition, a tight seal around the ear canal may be difficult to achieve. Consequently, in-ear canal earphones can be prone to slippage during use.

SUMMARY OF EMBODIMENTS OF THE INVENTION

According to embodiments of the current invention, an in-ear canal earphone includes a generally torus-shaped cushioning member defining an aperture therethrough. An audio housing is connected to the cushioning member such that the cushioning member is movable between a first position, in which the housing extends generally away from the cushioning member, and a second position, in which a portion of the housing extends through the aperture for insertion into an ear canal.

In certain embodiments, the cushioning member is configured to move between the first and second positions during insertion into the ear canal without substantially relative sliding movement between the cushioning member and the ear canal.

In certain embodiments, the cushioning member and the housing are configured to be inserted into an ear canal and the cushioning member is configured to cushion and secure the audio housing in the ear canal when the housing is in the second position. In some embodiments, the cushioning member and the housing are configured to be inserted at least partially into an ear canal when the housing moves between the first and the second position.

In particular embodiments, the housing includes an elongated portion configured to extend through the aperture and into an ear canal in the second position. The elongated portion of the housing can include a first end proximate the cushioning member when the housing is in the first position and a second end that is distal to the cushioning member when the housing is in the second position. A cross-sectional area of the first end of the elongated portion of the housing can be greater than the cross-sectional area of the second end of the elongated portion of the housing. The audio housing further includes a speaker, e.g., connected to the elongated portion at the second end thereof.

In particular embodiments, the cushioning member has a non-symmetric shape configured to retain the earphone in the ear canal after insertion In some embodiments, the cushioning member includes a textured surface configured to increase friction between the cushioning member and the ear canal.

In particular embodiments, the audio housing includes a cell phone headset.

According to further embodiments of the present invention, methods of inserting an in-ear canal earphone include providing an in-ear canal earphone comprising a torus-shaped cushioning member defining an aperture therethrough and an audio housing connected to the cushioning member. The cushioning member is positioned adjacent an ear canal in a first position in which the housing extends generally away from the cushioning member. A portion of the housing is inserted into the ear canal. The cushioning member is moved from the first position to a second position in which the portion of the housing extends through the aperture as the housing is inserted into the ear canal.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF EMBODIMENTS OF THE INVENTION

Figure 1:
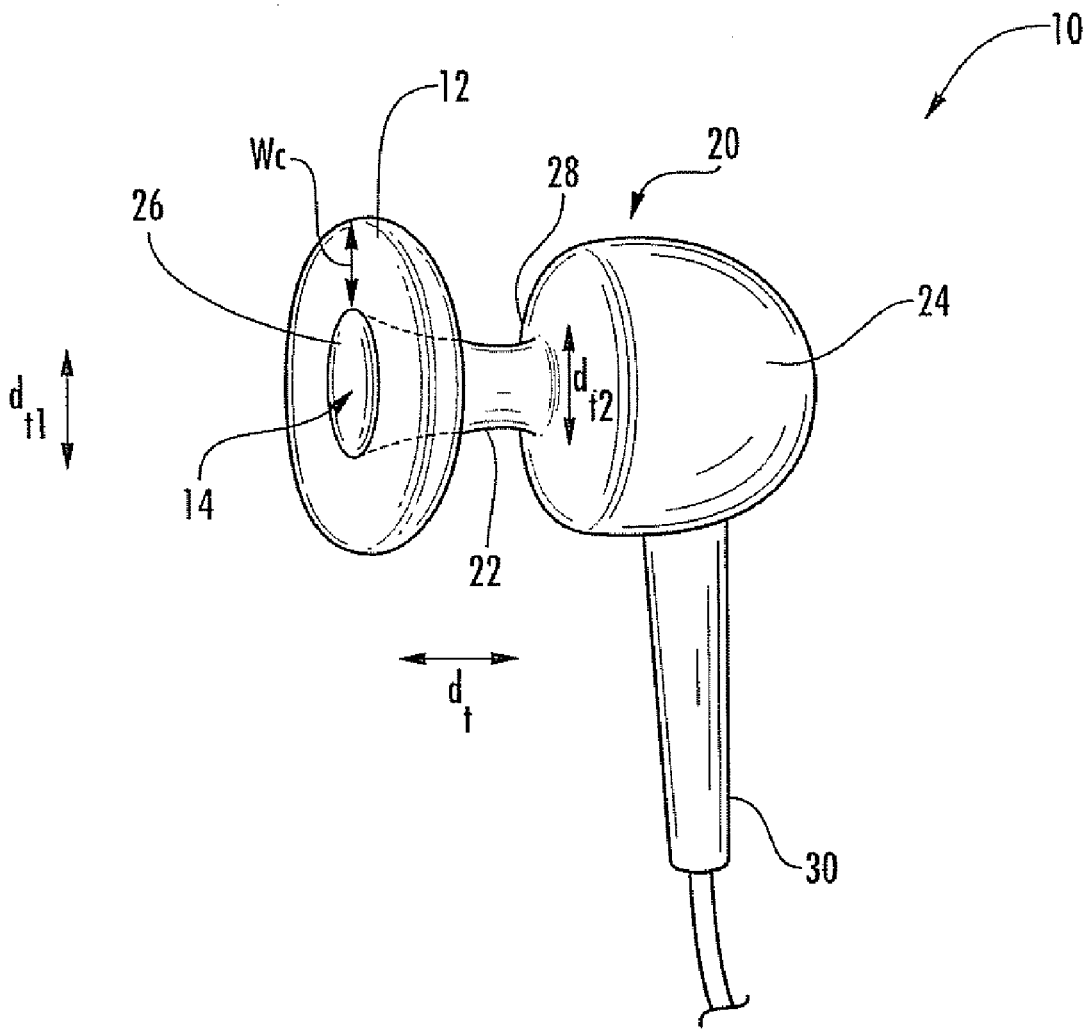
FIG. 1 is a perspective view of an in-ear earphone with a cushioning member and earphone housing according to embodiments of the present invention.

The present invention now will be described hereinafter with reference to the accompanying drawings and examples, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/ or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly couple" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, these elements should not be limited by these terms. These terms are only used to distinguish one element from another. Thus, a "first" element discussed below could also be termed a "second" element without departing from the teachings of the present invention. The sequence of operations (or steps) is not limited to the order presented in the claims or figures unless specifically indicated otherwise.

An in-ear earphone 10 according to embodiments of the present invention is illustrated in FIG. 1. The in-ear earphone includes a generally torus-shaped, flexible cushioning member 12 that defines an aperture 14 and an audio housing 20. The audio housing 20 includes an elongated portion or audio tube 22 and a speaker 24. As illustrated, the speaker 24 is connected by a wired connection 30. However, it should be understood that wireless connection, such as short-range Bluetooth® connections, can also be used such that the wired connection 30 is eliminated.

The term "torus" refers to any generally doughnut-shaped, three dimensional member, and includes any toroidal element. The torus-shaped cushioning members described herein can be generally circular, elliptical, or rectangular and can be either symmetrical or asymmetrical.

As illustrated in FIGS. 2-3 and 4A-43, the audio tube 22 and the cushioning member 12 are inserted into an ear canal 50. The audio tube 22 includes two ends 26, 28 and can provide acoustic coupling between the speaker 24 and the ear canal 50. The end 26 of the audio tube 22 is connected to the cushioning member 12 at a generally ring-shaped joint P such that the cushioning member 12 is movable between a first position (FIG. 2), in which the housing 20 extends generally away from the cushioning member 12, and a second position (FIG. 4A), in which a portion of the housing 20 extends through the aperture 14 of the cushioning member 12 and the audio tube 22 is inserted into the ear canal 50.

Figure 2:
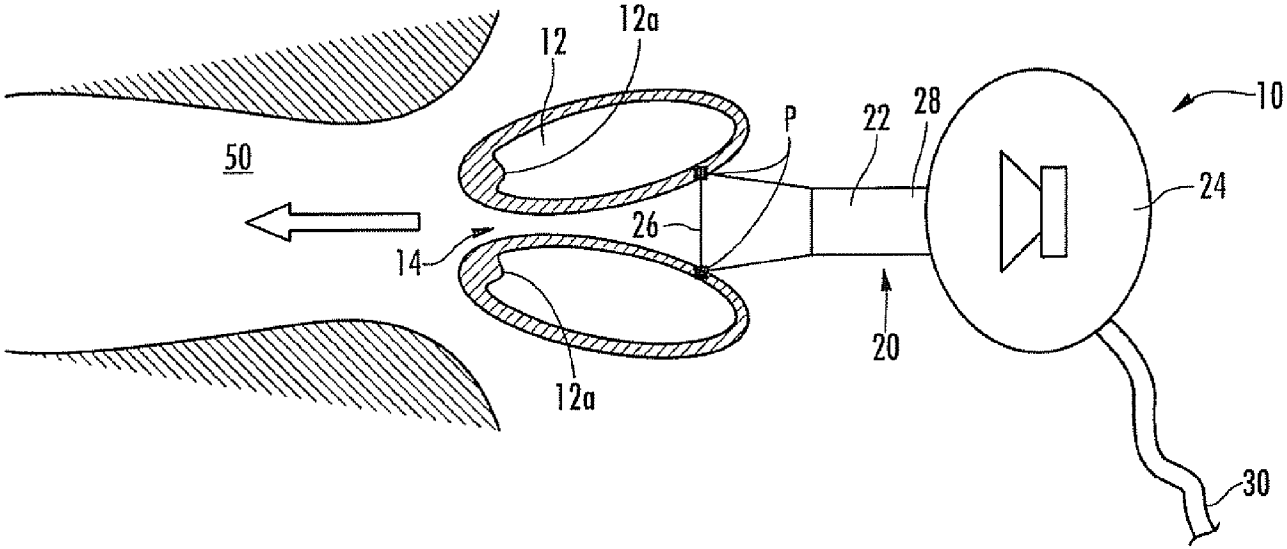
FIG. 2 is a side view of the in-ear earphone of FIG. 1 before insertion into an ear canal with the cushioning member in a first position in which the housing extends generally away from the cushioning member.
Figure 3:
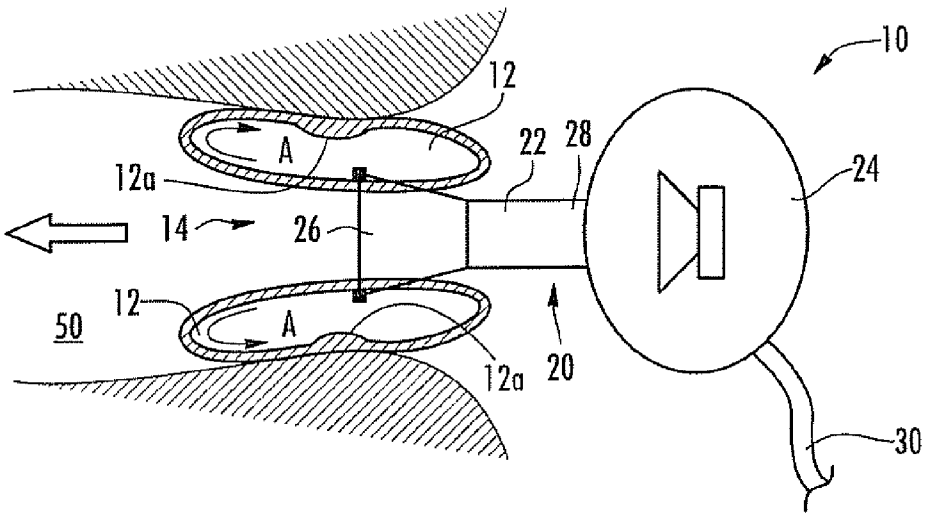
FIG. 3 is a side view of the in-ear earphone of FIG. 1 as the earphone is inserted into an ear canal.
Figure 4A:
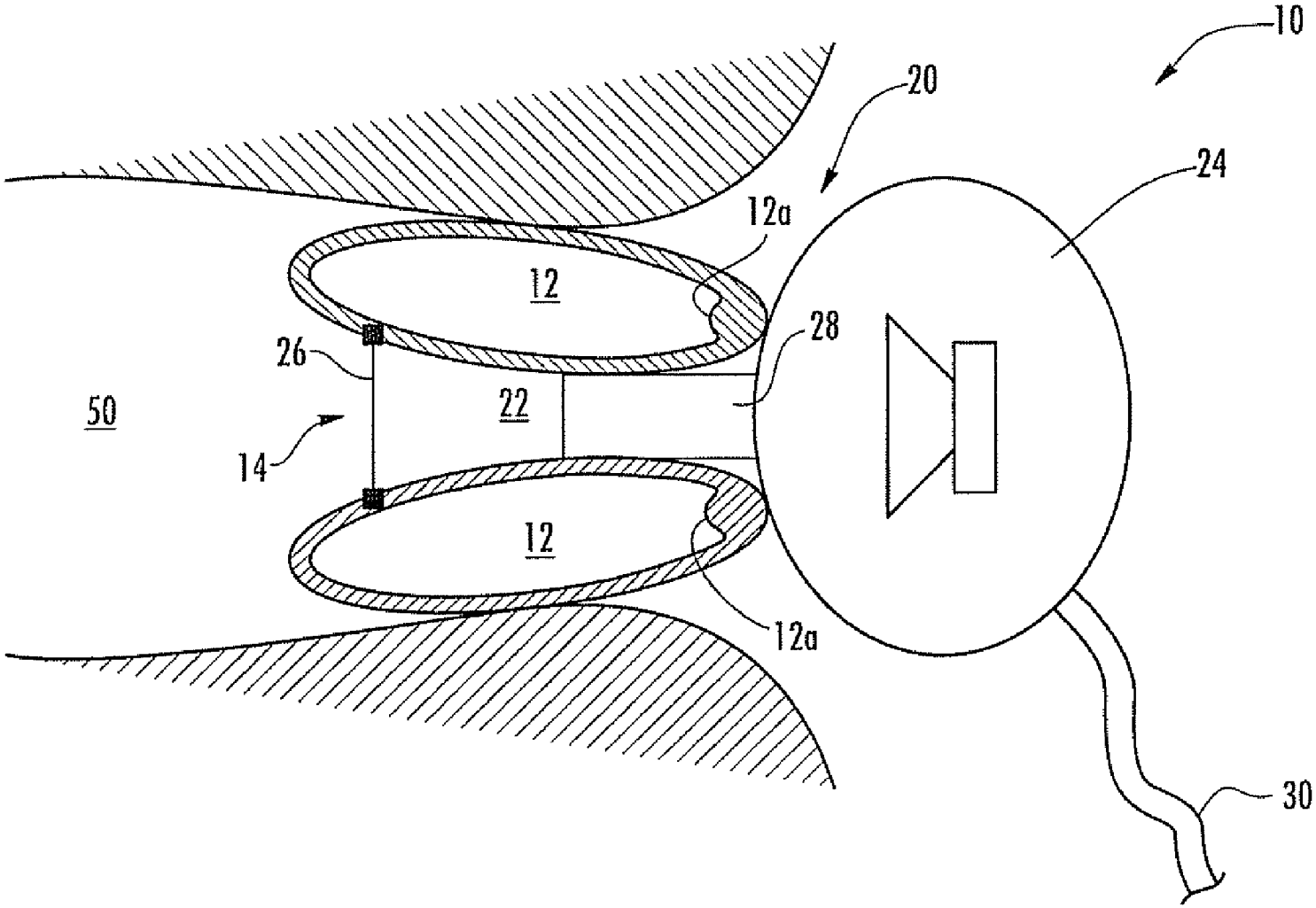
FIG. 4A is a side view of the in-ear earphone of FIG. 1 after insertion into the ear canal with the cushioning member in a second position in which a portion of the housing extends through the aperture in the cushioning member.
Figure 4B:
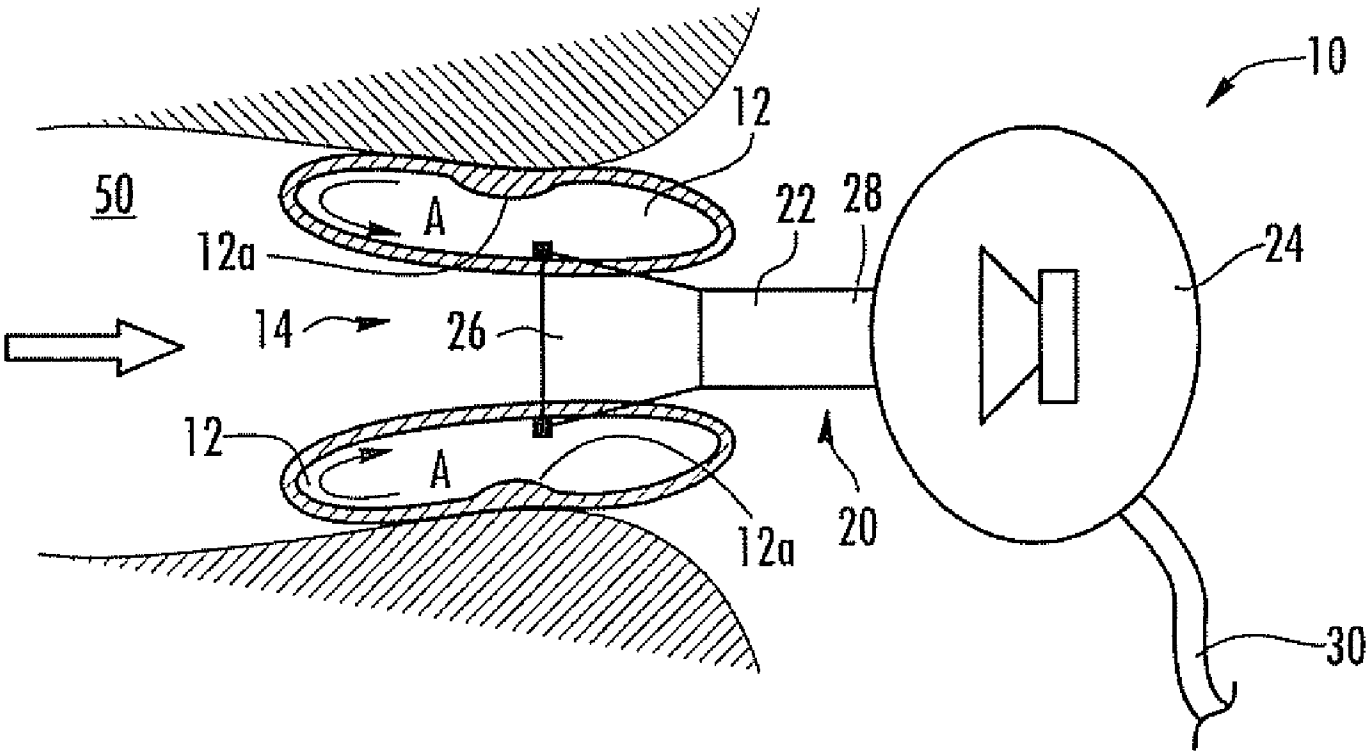
FIG. 4B is a side view of the in-ear earphone of FIG. 1 as the earphone is extracted from the ear.

As shown in FIG. 3, the cushioning member 12 is configured to move or roll with respect to the audio tube 22 as the audio tube 22 is inserted into the ear canal 50. The audio tube 22 can be inserted into the ear canal 50 in a relatively smooth motion because the surface of the cushioning member 12 contacts the ear canal 50 and moves with respect to the audio tube 22. For example, the outer surface of the cushioning member 12 can roll in continuous contact with the ear canal 50 as indicated in FIG. 3 by arrow A. The cushioning member 12 can contact the ear canal 50 in a substantially continuous movement with reduced or substantially eliminated frictional sliding between the cushioning member 12 and the ear canal 50. In other words, the frictional fit between the cushioning member 12 and the ear canal 50 does not need to be overcome in order to move the audio tube 22 into the ear canal 50 as shown in FIGS. 2-3 and 4A, and the cushioning member 12 and the audio tube 22 move between the first and second positions without substantial relative sliding movement between the cushioning member 12 and the ear canal 50. As shown in FIG. 4B, the cushioning member 12 is configured to move or roll in the direction of arrow A with respect to the audio tube 22 as the audio tube 22 is extracted from the car canal 50.

The cushioning member 12 can be formed of an elastomeric material or rubber that may be solid or a hollow outer shell filled with a liquid (such as a gel or water) or a gas. In some embodiments, a hollow outer shell filled with a liquid or a gas can facilitate the rolling motion of arrow A described herein (FIGS. 3 and 4B). Any suitable technique can be used to insert and/or extract the earphone 10 into the ear canal 50. As illustrated in FIG. 2, the cushioning member 12 can be compressed, for example, by the application of force from the user's fingers grasping the cushioning member 12 prior to insertion into the ear canal 50. However, in some embodiments, the cushioning member 12 remains in a generally uncompressed state during insertion into the ear canal 50. The cushioning member 12 can form a relatively tight seal in the ear canal 50. For example, the cushioning member 12 can be compressible/expandable so that the cushioning member 12 exerts a small amount of pressure on the ear canal 50 when it is released by the user during insertion. In some embodiments, the cushioning member 12 is sized to form a relatively tight seal with or without being compressible. In some embodiments the cushioning member 12 exerts sufficient pressure on the ear canal 50 to hold the cushioning member 12 in position as shown in FIG. 4A. In some embodiments, the cushioning member 12 can have a surface (such as a textured surface) that is configured to increase friction between the cushioning member 12 and the ear canal 50.

As illustrated in FIG. 1, the cushioning member 12 has a generally torus-shaped surface that has a width $w_c$ in an uncompressed position. The length of the audio tube 22 is distance $d_t$ and is a size that is generally able to be inserted in the ear canal 50 of the user. The audio tube 22 can have a generally conical shape such that the end 26 of the audio tube 22 has a diameter $d_{t1}$ that is greater than the diameter $d_{t2}$ of the end 28. The conical shape of the audio tube 22 can facilitate holding the earphone 10 in position in the ear canal 50 as shown in FIG. 4A. In particular embodiments, the width of the cushioning member $w_c$ is between about 2.5 and 5 mm, the length of the audio tube 22 $d_t$ is between about 5 and 10 mm, the diameter of the end 26 $d_{t1}$ is between about 4 and 5 mm, and the diameter of the end 28 $d_{t2}$ is between about 3 and 4 mm.

Although embodiments according to the present invention are illustrated with respect to the audio tube 22, it should be understood that any suitable shape can be used, including cylindrical shapes, and in some embodiments, the audio tube 22 has a generally constant diameter between the ends 26, 28. For example, other techniques can be used to hold the earphone 10 in position in the ear canal 50. In some embodiments, the cushioning member 12 can have an optional non-uniform wall thickness as indicated by the area 12A of increased thickness. The non-uniform wall thickness of area 12A introduces an internal strain in the cushioning member such that the positions before insertion in FIG. 2 and after insertion in FIG. 4A correspond to relatively lower strain endpoints. However, the area 12A introduces an increased strain during insertion or extraction of the earphone 10 as shown in FIGS. 3 and 4B such that there is a strain maxima where the internal force pushing the earphone 10 out of the ear canal 50 and the internal force pulling the earphone 10 into the ear canal 50 is in equilibrium in the substantial absence of the application of an external force, i.e., by the user. Between this maxima and the position of FIG. 4A, the cushioning member 12 exerts a force on the earphone 10 that pulls the earphone 10 into the ear canal 50 and retains the earphone in the inserted position of FIG. 4A.

Accordingly, it should be understood that the earphone 10 can be retained in the ear canal 50 by any suitable configuration, including a conical audio tube 22, other retaining member, and/or variations in the cushioning member 12 (such as a non-symmetric shape, e.g., a variable wall thickness as shown with respect to the area 12A).

In some embodiments, the cushioning member 12 can be removable, e.g., so that various sizes of cushioning members 12 can be used. For example, the cushioning member 12 can be attached to the audio tube 22 by a removable, snap-fit ring connector so that different interchangeable cushioning members 12 can be used with the housing 20 to accommodate users with different sizes of ear canals.

Figure 5:
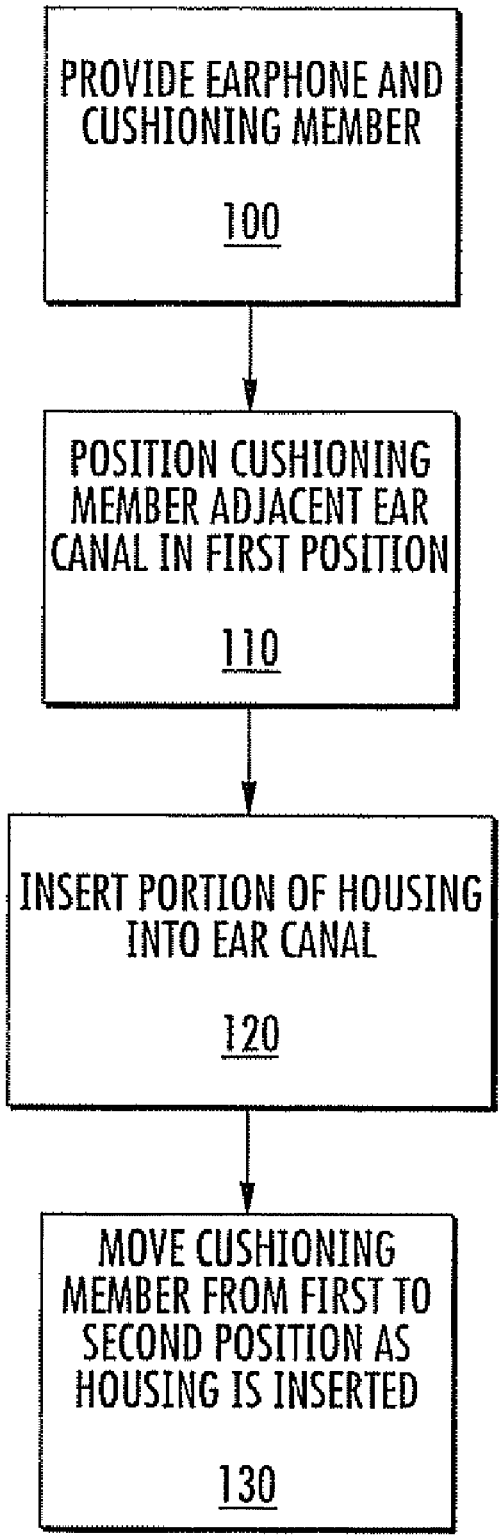
FIG. 5 is a flowchart illustrating operations according to embodiments of the present invention.

As illustrated in FIG. 5, operations according to embodiments of the present invention include providing an in-ear canal earphone with a cushioning member, such as the earphone 10 as described in FIGS. 1-3 and 4A-4B (Block 100). The cushioning member 12 is positioned adjacent an ear canal 50 in a first position as shown in FIG. 2 in which the housing extends generally away from the cushioning member (FIG. 5, Block 110). A portion of the housing 20 is inserted into the ear canal 50 as shown in FIGS. 2 and 3 (FIG. 5, Block 120). The cushioning member 12 is moved from the first position to a second position in which the portion of the housing 20 extends through the aperture 14 as the housing is inserted into the ear canal 50 (Block 130).

The cushioning members according to embodiments of the present invention can be manufactured from various materials using various processes understood by those of skill in Be art. Exemplary materials include, but are not limited to, polymeric materials such as silicon, thermoplastic elastomers (TPE) and exemplary manufacturing methods include, but are not limited to, injection molding and rotational molding.

The audio housing 20 can include electronics for headset operations known to those of skill in the art. For example, the audio housing 20 can include speaker electronics and/or communication electronics, such as Bluetooth® short-range wavelength communication electronics or conventional wired communications via the optional wired connection 30. The earphone 10 can be used with various electronic devices with audio capabilities, such as personal wirelessly enabled digital assistants (personal data assistants (PDAs), such as Palm Pilot™ or Pocket PC™ devices), cellular telephones and/or data terminals, pagers, wireless messaging devices (such as a Blackberry™ wireless handheld device), laptop computers, wireless enabled laptop computers, table top computers, land-line telephones, other mobile communications devices and/or combinations thereof The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An in-ear canal earphone comprising:

a generally torus-shaped cushioning member defining an aperture therethrough; and an audio housing connected to the cushioning member such that the cushioning member is movable between a first position, in which the housing extends generally away from the cushioning member, and a second position, in which a portion of the housing extends through the aperture for insertion into an ear canal, wherein the cushioning member is configured to form a friction contact point between a portion of the cushioning member and the ear canal such that as the cushioning member moves between the first and second positions during insertion into the ear canal, the friction contact point maintains a location of the portion of the cushioning member with respect to the ear canal at the friction contact point while additional portions of the cushioning member advance into the ear canal.

2. The earphone of claim 1, wherein the cushioning member and the housing are configured to be inserted into an ear canal and the cushioning member is configured to cushion and secure the audio housing in the ear canal when the housing is in the second position.

3. The earphone of claim 1, wherein the cushioning member and the housing are configured to be inserted at least partially into an ear canal when the housing moves between the first and the second position.

4. The earphone of claim 1, wherein the housing comprises an elongated portion configured to extend through the aperture and into an ear canal in the second position.

5. The earphone of claim 4, wherein the elongated portion of the housing includes a first end proximate the cushioning member when the housing is in the first position and a second end that is distal to the cushioning member when the housing is in the second position, wherein a cross-sectional area of the first end of the elongated portion of the housing is greater than the cross-sectional area of the second end of the elongated portion of the housing.

6. The earphone of claim 1, wherein the cushioning member has a non-symmetric shape configured to hold the earphone in the ear canal after insertion.

7. The earphone of claim 1, wherein the audio housing further comprises a speaker.

8. The earphone of claim 1, wherein the cushioning member comprises a textured surface configured to increase friction between the cushioning member and the ear canal.

9. The earphone of claim 1, wherein the audio housing comprises a cell phone headset.

* * * * *

UNITED STATES PATENT AND TRADEMARK OFFICE

CERTIFICATE OF CORRECTION

PATENT NO. : 8,160,288 B2
APPLICATION NO. : 12/036473
DATED : April 17, 2012
INVENTOR(S) : Axelsson It is certified that error appears in the above-identified patent and that said Letters Patent is hereby corrected as shown below:

In the Patent:

Column 4, Line 10: Please correct "and 4A-43," to read -- and 4A-4B, --

Column 6, Line 5: Please correct "skill in Be" to read -- skill in the --

Signed and Sealed this
Fifth Day of February, 2013

Teresa Stanek Rea
*Acting Director of the United States Patent and Trademark Office*